US012421751B1

(12) United States Patent
Stierwalt

(10) Patent No.: US 12,421,751 B1
(45) Date of Patent: Sep. 23, 2025

(54) RETROFITTABLE STABILIZER FOR UTILITY POLES AND COLUMNS

(71) Applicant: Mikel R. Stierwalt, Shidler, OK (US)

(72) Inventor: Mikel R. Stierwalt, Shidler, OK (US)

( * ) Notice: Subject to any disclaimer, the term of this patent is extended or adjusted under 35 U.S.C. 154(b) by 0 days.

(21) Appl. No.: 18/736,414

(22) Filed: Jun. 6, 2024

(51) Int. Cl.
*E04H 12/22* (2006.01)

(52) U.S. Cl.
CPC ..... *E04H 12/2292* (2013.01)

(58) Field of Classification Search
CPC ..... E04H 12/2292; E04H 12/2246; E04H 12/2269; E04H 12/347; E02D 27/42; E02D 27/02
See application file for complete search history.

(56) References Cited

U.S. PATENT DOCUMENTS

| | | | |
|---|---|---|---|
| 1,258,839 | A | 3/1918 | Wheeler |
| 1,438,074 | A | 12/1922 | Welch |
| 1,448,243 | A | 3/1923 | Wilson |
| 1,463,715 | A | 7/1923 | Muhlow |
| 1,486,594 | A | 3/1924 | Malone |
| 1,712,510 | A | 5/1929 | Monie |
| 3,202,217 | A | 8/1965 | Watts et al. |
| 3,514,911 | A | 6/1970 | Preradovich |
| 4,099,354 | A | 7/1978 | DePirro |
| 4,218,858 | A | 8/1980 | Legler |
| 4,335,740 | A | 6/1982 | Boley |
| 4,416,328 | A | 11/1983 | Baski |
| 4,455,795 | A | 6/1984 | Cole |
| 4,696,330 | A | 9/1987 | Raudman et al. |
| 4,717,036 | A | 1/1988 | Dundas et al. |
| 4,842,443 | A | 6/1989 | Argandona |
| 5,060,435 | A | 10/1991 | Bogdanow |
| 5,098,220 | A | 3/1992 | Norman |
| 5,114,271 | A | 5/1992 | Sunderhaus |

(Continued)

FOREIGN PATENT DOCUMENTS

| | | |
|---|---|---|
| AU | 199879941 | 11/1998 |
| CA | 2238456 | 6/2002 |

(Continued)

OTHER PUBLICATIONS

USPTO; first Office Action, mailed Aug. 27, 2018, in related U.S. Appl. No. 15/669,312, filed Aug. 4, 2017.

(Continued)

*Primary Examiner* — Gisele D Ford
(74) *Attorney, Agent, or Firm* — Robert H. Frantz

(57) ABSTRACT

A retrofittable modular stabilizer system for a vertical structure, such as a pole or a structural column, is disclosed having a bottom portion having at least two edges; two co-planar half-panels, joined to a first edge of the bottom portion and separated by a through-channel portion between the half-panels; at least one side wall joined to a second edge of the bottom portion and joined to the half-panels, thereby forming a ballast container with an open top and configured to mate to another modular stabilizer component at the half-panels, configured to receive and capture a vertical structure into the through-channel; and one or more fasteners configured to fasten two modular stabilizer components together around the captured vertical structure, or to fasten at least one modular stabilizer component to the captured vertical structure, or both.

10 Claims, 12 Drawing Sheets

(56) References Cited

U.S. PATENT DOCUMENTS

| | | | | |
|---|---|---|---|---|
| 5,133,164 | A | 7/1992 | Legler | |
| 5,228,506 | A | 7/1993 | Pearce | |
| 5,317,844 | A | 6/1994 | Legler | |
| 5,377,748 | A | 1/1995 | Gayaut | |
| RE35,272 | E | 6/1996 | Mathieson et al. | |
| 5,531,419 | A * | 7/1996 | Gustafsson | H01Q 1/1235 343/882 |
| 5,535,556 | A | 7/1996 | Hughes, Jr. | |
| 6,655,097 | B1 | 12/2003 | Poolaw | |
| 6,799,401 | B1 | 10/2004 | Legler | |
| 6,915,618 | B2 | 7/2005 | Payne | |
| 7,216,839 | B2 * | 5/2007 | Xiaoqiu | E04H 12/2246 248/910 |
| 7,363,752 | B2 | 4/2008 | Bingel, II et al. | |
| 7,415,808 | B2 | 8/2008 | Bingel, II et al. | |
| 7,637,470 | B2 * | 12/2009 | Siu | E01F 9/681 248/519 |
| 7,637,692 | B1 | 12/2009 | Rose | |
| 7,770,333 | B2 | 8/2010 | Meyers | |
| 7,966,786 | B2 | 6/2011 | Koteskey | |
| 7,987,904 | B1 | 8/2011 | Rose | |
| 8,127,837 | B1 | 3/2012 | Rose | |
| 8,256,505 | B1 | 9/2012 | Rose | |
| 8,485,250 | B1 | 7/2013 | Rose | |
| 8,695,305 | B2 * | 4/2014 | Gallagher | E04H 12/2238 52/656.9 |
| 9,175,550 | B2 | 11/2015 | Dunlavy | |
| 9,435,435 | B2 | 9/2016 | Gavin | |
| 9,499,954 | B2 * | 11/2016 | Shi | E02D 27/02 |
| 9,540,840 | B2 * | 1/2017 | Ma | F16M 13/00 |
| 9,657,491 | B1 * | 5/2017 | Mansueto | A47G 33/12 |
| 9,771,734 | B2 | 9/2017 | Odegard et al. | |
| 9,777,500 | B1 | 10/2017 | Reisdorff | |
| 10,202,816 | B1 | 2/2019 | Stierwalt | |
| 10,605,031 | B2 | 3/2020 | Stierwalt | |
| 10,648,191 | B1 | 5/2020 | Oliphant et al. | |
| D919,282 | S * | 5/2021 | Chen | D3/10 |
| D952,323 | S * | 5/2022 | Kohen | D3/10 |
| D952,324 | S * | 5/2022 | Kohen | D3/10 |
| 11,365,556 | B1 | 6/2022 | Anderson et al. | |
| 11,821,225 | B1 * | 11/2023 | Smith | A45B 23/00 |
| D1,024,538 | S * | 4/2024 | Kohen | D3/10 |
| 2003/0033281 | A1 | 2/2003 | Ritz | |
| 2003/0051882 | A1 | 3/2003 | Hitchon | |
| 2004/0056169 | A1 * | 3/2004 | Harbaugh | E04H 12/2246 248/910 |
| 2004/0069922 | A1 * | 4/2004 | Wu | E04H 12/2246 248/519 |
| 2006/0053714 | A1 | 3/2006 | Pryor et al. | |
| 2006/0236647 | A1 | 10/2006 | Fehr | |
| 2007/0031190 | A1 | 2/2007 | Meyers | |
| 2007/0256388 | A1 | 11/2007 | Ianello et al. | |
| 2008/0224016 | A1 * | 9/2008 | Defu | E04H 12/2246 248/523 |
| 2009/0057518 | A1 | 3/2009 | Russell | |
| 2009/0217607 | A1 | 9/2009 | Stark | |
| 2010/0257794 | A1 | 10/2010 | Stark | |
| 2011/0138704 | A1 | 6/2011 | Bagepalli et al. | |
| 2011/0259602 | A1 | 10/2011 | Britton | |
| 2013/0146739 | A1 * | 6/2013 | Zhao | E04H 12/2246 248/519 |
| 2013/0227897 | A1 | 9/2013 | Palmer et al. | |
| 2014/0054529 | A1 * | 2/2014 | Whiteley | E01F 9/692 256/31 |
| 2014/0208683 | A1 | 7/2014 | Soucy et al. | |
| 2015/0136283 | A1 | 5/2015 | Rensch | |
| 2015/0308140 | A1 * | 10/2015 | Clifton | E02D 27/42 248/346.2 |
| 2016/0138297 | A1 | 5/2016 | Gibbs et al. | |
| 2017/0058548 | A1 | 3/2017 | Stevens et al. | |
| 2017/0183840 | A1 * | 6/2017 | Tozer | E02D 27/425 |
| 2018/0128417 | A1 * | 5/2018 | Rosenberg | E02D 27/00 |
| 2018/0334828 | A1 * | 11/2018 | Pan | E04H 12/2246 |
| 2020/0208429 | A1 * | 7/2020 | Ma | E04H 12/2238 |
| 2021/0310269 | A1 * | 10/2021 | Dinse | B65D 85/20 |
| 2022/0243493 | A1 | 8/2022 | Fadel | |
| 2023/0220647 | A1 * | 7/2023 | Spiro | E02D 27/42 52/125.2 |
| 2023/0279688 | A1 * | 9/2023 | Russell | E04B 1/64 |
| 2023/0287700 | A1 * | 9/2023 | Phillips | E04H 12/2238 |
| 2024/0052590 | A1 * | 2/2024 | Reski | F16M 5/00 |

FOREIGN PATENT DOCUMENTS

| | | |
|---|---|---|
| WO | 8803593 | 5/1988 |
| WO | 9618788 | 6/1996 |
| WO | 2006045141 | 5/2006 |
| WO | 2010093268 | 8/2019 |

OTHER PUBLICATIONS

Stierwalt, Mikel R.; Applicant's reply to first Office Action, submitted on Sep. 12, 2018, in related U.S. Appl. No. 15/669,312, filed Aug. 4, 2017.

USPTO; Notice of Non-Compliant Amendment, mailed Oct. 17, 2018, in related U.S. Appl. No. 15/669,312, filed Aug. 4, 2017.

Stierwalt, Mikel R.; Applicant's reply to Notice of Non-compliant Amendment, submitted on Oct. 22, 2018, in related U.S. Appl. No. 15/669,312, filed Aug. 4, 2017.

USPTO; Notice of Allowance, mailed Nov. 29, 2018, in related U.S. Appl. No. 15/669,312, filed Aug. 4, 2017.

USPTO; first Office Action mailed on Jun. 10, 2019 in related U.S. Appl. No. 16/248,195, filed Jan. 15, 2019 by Mikel R. Stierwalt.

Stierwalt, Mikel R.; Applicant's reply submitted on Oct. 16, 2019 in related U.S. Appl. No. 16/248,195, filed Jan. 15, 2019 by Mikel R. Stierwalt.

USPTO; Notice of Allowance mailed on Nov. 25, 2019 in related U.S. Appl. No. 16/248,195, filed Jan. 15, 2019 by Mikel R. Stierwalt.

Wikipedia; "File: Welhead-dueal completion.jpg", retrieved on Jun. 19, 2017 from https://it.wikipedia.org/wiki/File:Wellhead-dual_completion.jpg.

Upstream Pumping; "Wellhead Oil Spill Prevention Challenges Production"; retrieved on Jun. 19, 2017 from http://www.upstreamepumping.com.

Bing; search result for "oil well wellhead" image; retrieved on Jun. 19, 2017 from http://www.bing.com/images/search?view=detailV2&ccid=XphzHalz&id=627B4C86DE72CCFE5B5CE4E0CADF4AAADCE9D566&thid=OIP.XphzHalzEVpknT-g3YcsVgEsDh&q=oil+well+head&simid=607996740311976370&selectedIndex=0&ajaxhist=0.

Adoil; Titan Containment; retrieved on Jun. 19, 2017 from http://adoil.net/titan-containment/.

OSHA; "Cellar" definition; retrieved on Jun. 15, 2017 from https://www.osha.gov/SLTC/etools/oilandgas/illustrated_glossary/cellar.html.

Definedterm; "Cellar" definition, retrieved on Jun. 15, 2017 from https://definedterm.com/a/definition/193893.

Cellar Tech; "Containment Cellars", retrieved on Jun. 15, 2017 from http://cellartech.com/containment-well-cellars/.

Cellar Tech; "Containment Well Systems", retrieved on Jun. 15, 2017 from http://cellartech.com/wp-content/uploads/2016/07/Cellar-Tech-Well-Cellar-Presentation.pdf.

Cellar Tech; Containment Well Cellar Installation; retrieved on Jun. 15, 2017 from http://cellartech.com/well-cellar-installation/.

IADC Lexicon; "Cellar" definition; retrieved on Jun. 15, 2017 from http://www.iadclexicon.org/cellar/.

Croft Systems; The Difference Between a Wellhead & Christmas Tree; retrieved on Jun. 15, 2017 from https://www.croftsystems.net.

OGPE; "Oil, gas well cellars / trenches access wellhead equipment"; May 31, 2011.

Hubbell; "Guy attachments"; retrieved from https://www.hubbell.com on Apr. 15, 2024.

Bon Tool; "Pole Stabilizer with Spring Clip"; retrieved on Apr. 15, 2024 from https://www.bontool.com.

Linewise; "Direct Embed Pole Stabilization System"; retrieved on Apr. 15, 2024 from https://line-wise.com.

(56) References Cited

OTHER PUBLICATIONS

Oklahoma Design Technologies; "Ver-T-Pol Training Manual"; retrieved on Jun. 6, 2024 from http://www.oklahomadesigntech.com/polesupport.html.
Rax; "No-wrench screw anchor"; retrieved on Apr. 15, 2024 from https://www.hbjinyong.com.
Rax; "Bust exanding anchor"; retrieved on Apr. 15, 2024 from https://www.hbjinyong.com.
Rax; "Pole key anchor"; retrieved on Apr. 15, 2024 from https://www.hbjinyong.com.
Rax; "Power hub screw anchor"; retrieved on Apr. 15, 2024 from https://www.hbjinyong.com.
Underground Infrastructure; "Support Poles when Trenching/Excavating with VER-T-POL"; retrieved on Apr. 15, 2024 from https://undergroundinfrastructure.com.

* cited by examiner

RETROFITTABLE STABILIZER FOR UTILITY POLES AND COLUMNS

INCORPORATION BY REFERENCE

U.S. Pat. No. 10,605,031 B1 issued Mar. 31, 2020, is incorporated by reference in its entirety, including diagrams, into the present patent application.

FIELD OF THE INVENTION

The present invention relates to devices, systems and methods for stabilizing poles and columns, such as but not limited to utility poles for distributing electricity or telecommunications.

BACKGROUND OF THE INVENTION

Utility poles are well known in the art for requiring continuous surveillance and maintenance, especially those which are located remotely or in rural areas where they are not seen during common, every day activities by drivers, farmers, passersby, and utility workers. Remotely-located poles can be difficult to access, such as poles located in right-of-way areas that are surrounded by private land, and replacing such poles can be very expensive.

FIG. 4A shows 400 a simplified depiction of a row of utility poles 401, 401' and 401" set into a base 750 such as earth, rock, concrete, or payment, upon which one or more payload 402 cables, wires, optical fibers, antenna, etc., may be strung, hung, or installed. Poles located at the end of a line of poles, such as 401, or at a corner or sharp turn row of poles can experience a force $f_{lines}$ exerted by the weight of the payload towards the rest of the poles. Poles located in-line with the row of poles, such as 401' and 401", have such forces on them, but those forces are offset by the weight of the lines on the other side of the pole. As such, poles at the end of a line of poles or at a corner in the row of poles have net force impending on the top of the poles due to the imbalance of the weight of the lines. Many poles are set into the base material simply by digging or auging a hole into the base material, standing the pole upright in vertical alignment v, and backfilling the hole around the bottom of the pole to hold it into place.

This is an acceptable installation method if the base material is strong and stable, if the poles are not heavily weighted, and if typical wind and weather patterns are not expected to be strong enough to uproot or tilt the poles.

If the base material is not strong enough or stable enouch, such as erosion caused by flooding of normally dry land, or if the weather pattern exceeds the expected forces such as tornado winds or ice accumulation on the lines, an end or corner pole is often the first to tilt way from vertical v as shown in FIG. 4*b*. Because of the already-unbalanced nature of the configuration of the end and corner poles, they tend to fall first, often initiating a domino effect that pulls down additional poles.

However, in installations where the base material is too weak or unstable, where the pole load is too great, or the expected weather conditions are to strong, poles may be installed as shown 400' in FIG. 4B.

FIG. 5 shows 500 a variety of common methods to try to strengthen poles against such damaging conditions. For example, guy wires 503 which are anchored to the ground 750 may be installed to offset partially or completely the imbalance of the weight of the load on the end and corner poles. This guy wires, however, provide a vector of force in a downward direction putting the pole into additional compression. Wooden poles with guy wires may actually bend or buckle under such additional force. Concrete or expanding foam 501 may be installed around the bottom of the poles to provide stronger connection to the base material 750, and to add weight which must be lifted and/or rotated by forces impending on the middle and top portions of the poles. Pouring and removing concrete increases the cost and time to install the poles and to replace the poles. Diagonal supports, trusses or beams 502 may be added to the lower portion of the pole, as well. Combinations of these devices and methods may also be used.

SUMMARY OF THE INVENTION

A retrofittable modular stabilizer system for a vertical structure, such as a pole or a structural column, is disclosed having a bottom portion having at least two edges; two co-planar half-panels, joined to a first edge of the bottom portion and separated by a through-channel portion between the half-panels; at least one side wall joined to a second edge of the bottom portion and joined to the half-panels, thereby forming a ballast container with an open top and configured to mate to another modular stabilizer component at the half-panels, configured to receive and capture a vertical structure into the through-channel; and one or more fasteners configured to fasten two modular stabilizer components together around the captured vertical structure, or to fasten at least one modular stabilizer component to the captured vertical structure, or both.

BRIEF DESCRIPTION OF DRAWINGS

The figures presented herein, when considered in light of this description, form a complete disclosure of one or more embodiments of the invention, wherein like reference numbers in the figures represent similar or same elements or steps.

DETAILED DESCRIPTION

The present inventor has recognized certain unmet needs in the art of stabilizing utility poles and columns, despite a large number of previous attempts to solve the problem completely. As discussed in the foregoing paragraphs, various devices and installation techniques have been brought market, many of which are used in the industry today, but which do not solve all of the needs in the art.

For example, poured concrete bases on utility poles generally is done upon initial installation. Not all poles will lean if placed directly into the ground, so pouring concrete bases on all new poles may be unnecessary on many of them, causing unnecessary costs, time, and a waste of materials. External diagonal bracing may be added after poles are installed and after it can be seen which ones will lean or tilt over time, but external bracing is only as solid as the surface of the ground onto which they depend. Guy wires suffer the same shortcomings as diagonal bracing, and both guy wires and external bracing may pose a safety hazard to nearby operators of mowers, all terrain vehicles, skiers, snowmobilers, etc.

Applicant's previously U.S. Pat. Nos. 10,202,816, and 10,605,031, disclosed retrofittable containment cellars for well pipe "Christmas trees" which extend above ground but often leak fluids. In those patents, the present inventor outlined the unmet needs in the art to only install containment cellars around well pipes which leak, and not around all well pipes, and to do so in a way that is minimally intrusive without shutting down the flow of liquids through the well pipes.

The present inventor has realized that, with certain improvements and modifications, a similar retrofittable structure and corresponding method of use can be useful in satisfying the unmet needs in the fields of stabilizing utility poles and columns, with minimally invasive installation methods, while avoiding or considerably reducing any hazards to surface level activities (mowing, skiing, etc.), and with certain additional benefits not provided by the known stabilizing devices and methods.

Figure 1:
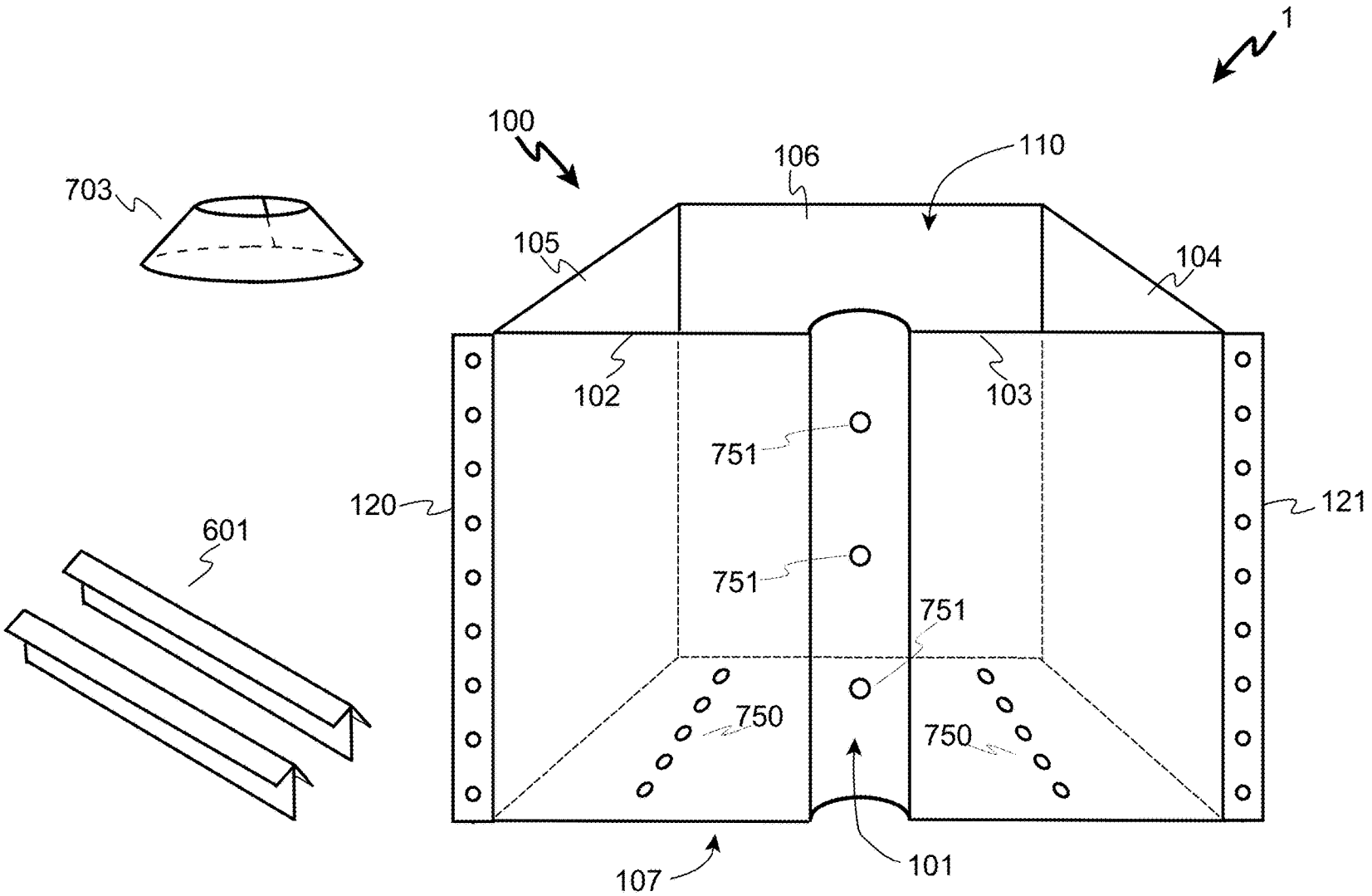
FIG. 1 illustrates a component kit of a rectangular stabilizer for utility poles and columns according to at least one embodiment of the present invention.

Basic Stabilizer Kit. Referring to FIG. 1, a kit 1 of components according to at least one embodiment of the present invention is shown, including two or more stabilizer components 100, one or more optional rain diverter ridge caps 601, and one or more optional diverter cones 703. The stabilizer components are optionally provided with a means for attaching them to each other, such as a set of flanges 120, 121 with holes for nuts and bolts. Whereas this particular invention may capture rain, snow melt, and surface flood waters into its interior volume 110, the structure of the previous inventor's patents is improved by adding one or more drain holes 750 in the bottom, sides, or both bottom and sides of the device. Additionally, one or more mounting holes 751 are optionally provided in the pole-receiving channel 101 for using optional attachment devices, such as lag bolts, to a pole such as a wooden telephone or wooden electric utility pole.

Figure 2:
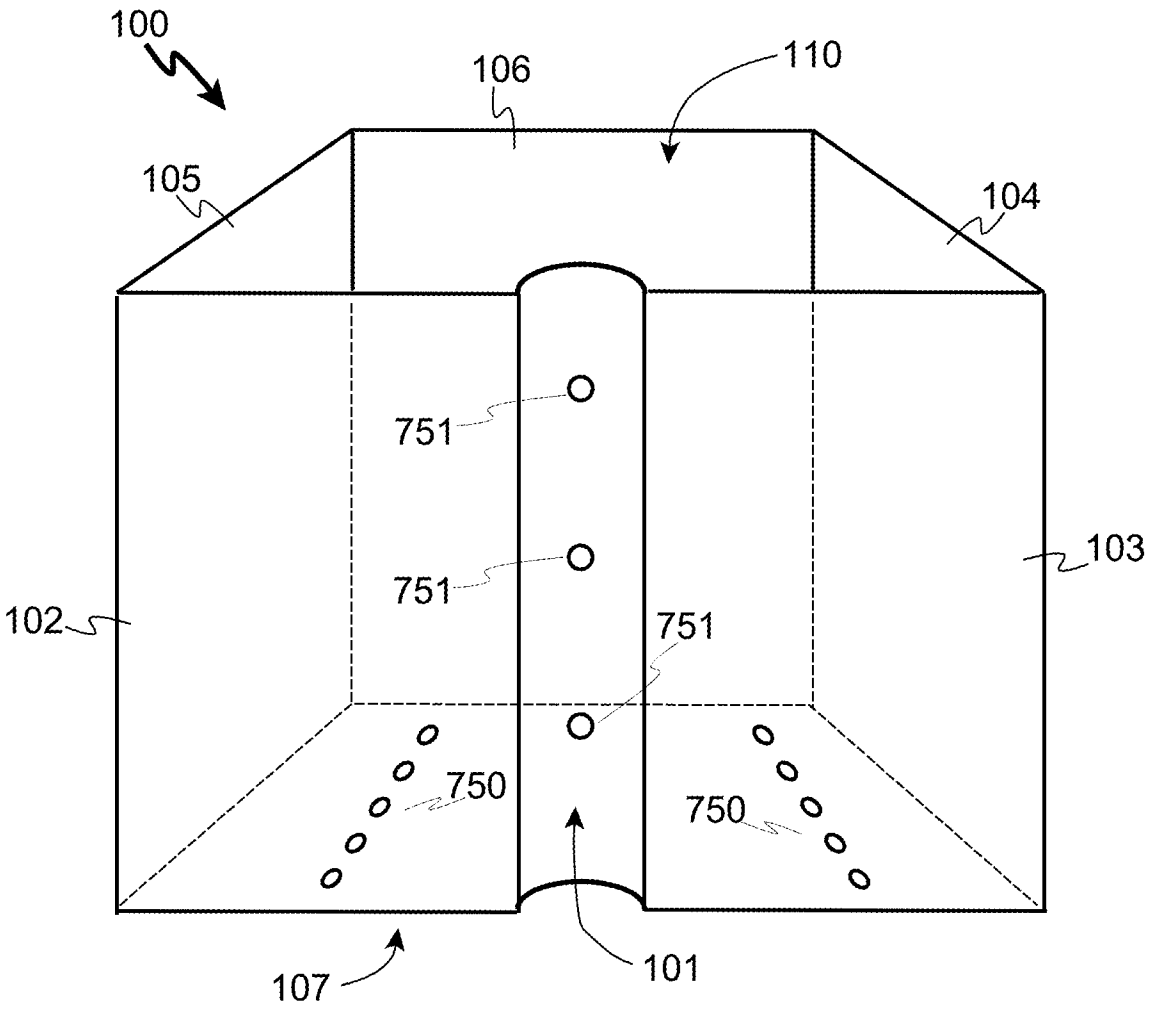
FIG. 2 provides mating-side view of a simplified illustration of key portions of one component of a rectangular stabilizer for utility poles and columns according to at least one embodiment of the present invention.

Stabilizer Components. FIG. 2 shows a simplified structure for one embodiment of a stabilizer component 100 according to the present invention, which as generally rectangular in shape, having a bottom 107, two half panels 102 and 103 with a pole-receiving through-channel 101 formed between the half panels and the bottom 107, two side panels 104, 105, and a panel 106 juxtaposed to the pole-receiving through-channel 101. These sides and the bottom form a sufficiently closed container with an open top 110 for receiving ballast materials, such as rock, gravel, concrete, sand, dirt, etc., and optionally for receiving rain, snowmelt, and the like. In some embodiments, a lid or top to the stabilizer component may be provided, as well. By sufficiently closed, we mean that that any openings, gaps or drains formed in the component 100 is for allowing liquids to exit are sufficiently small apertures to retain the ballast material or are covered by filter material to achieve the same containment of the ballast material.

Figure 3:
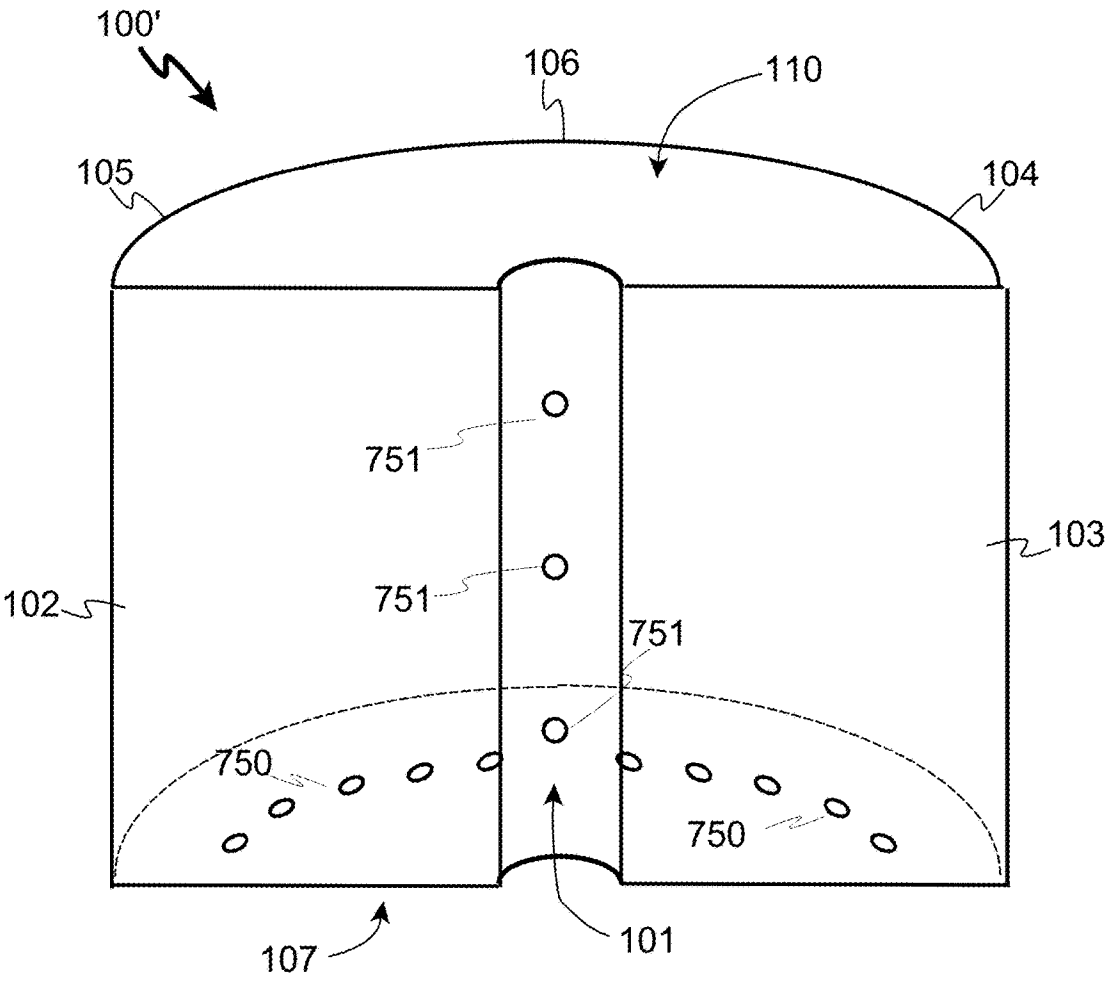
FIG. 3 depicts a mating-side view of a semi-cylindrical embodiment component of a retrofittable stabilizer for utility poles and columns according to at least one embodiment of the present invention.
Figure 4A:
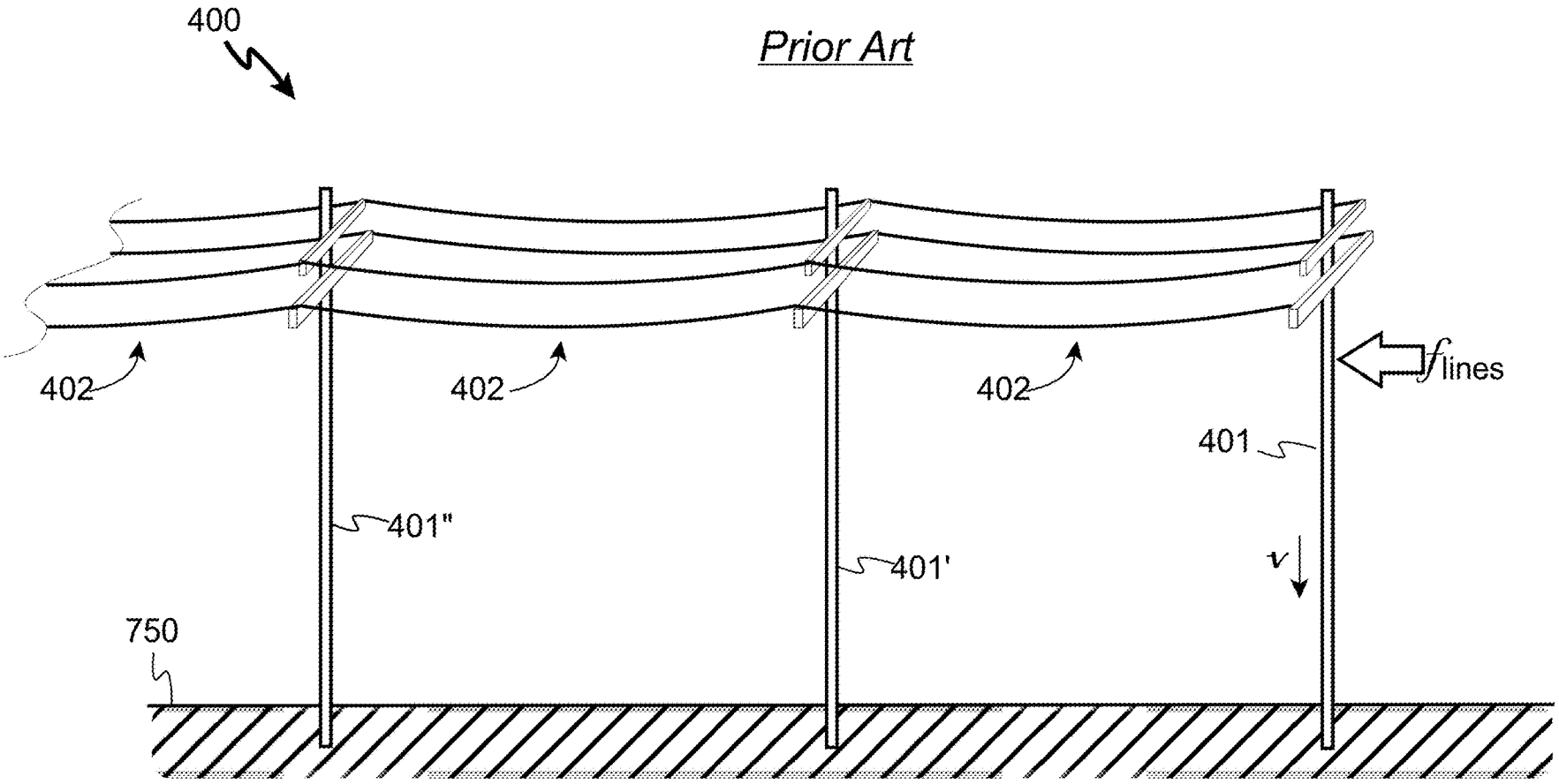
FIG. 4A illustrates a known configuration of utility poles.
Figure 4B:
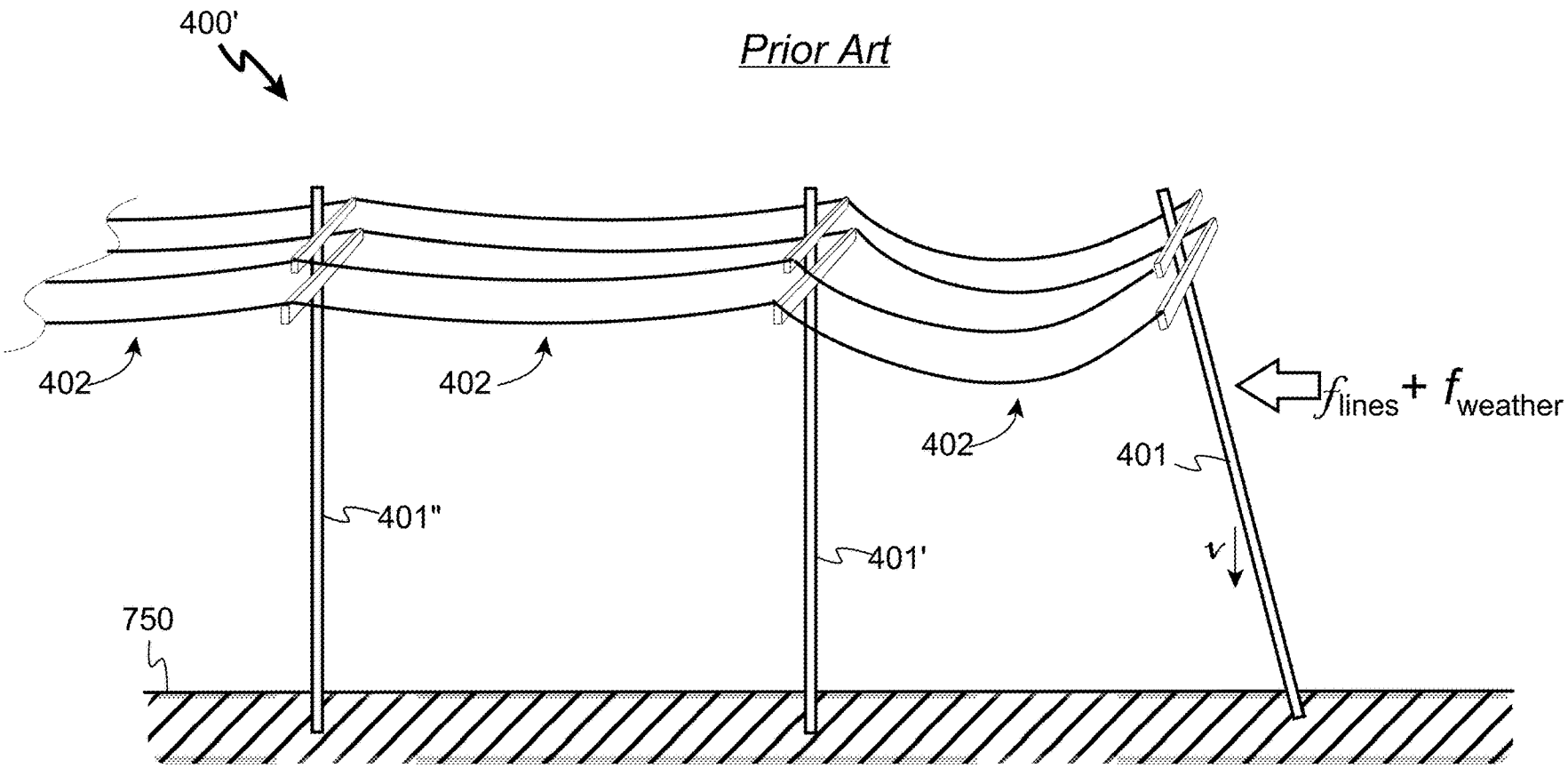
FIG. 4B illustrates a known problem with failures of utility poles.
Figure 5:
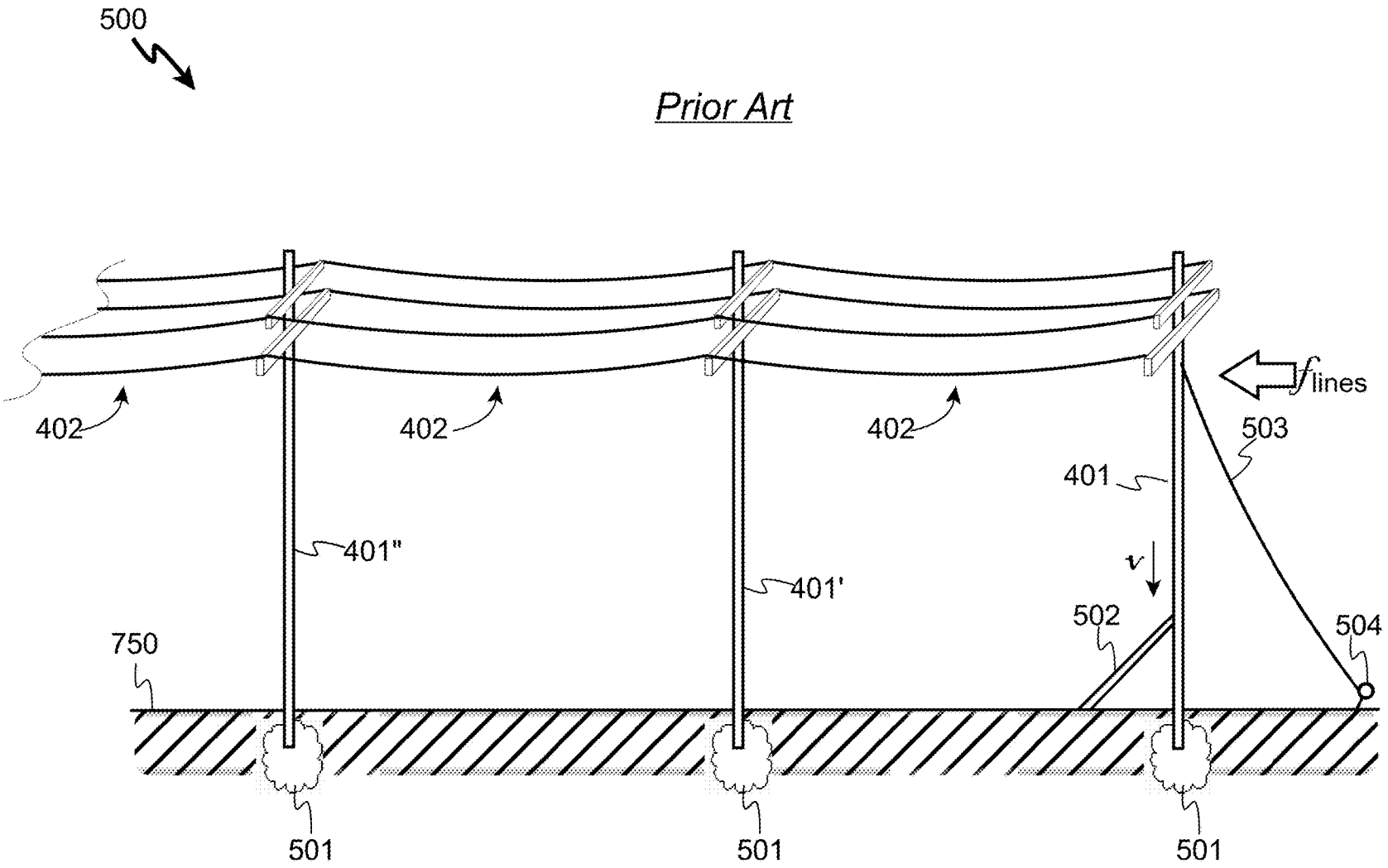
Prior Art Fig. 5
FIG. 5 depicts a variety of known methods and devices to strengthen and stabilize utility poles.

FIG. 3 illustrates another embodiment according to the present invention of a stabilizer component 100' which is semi-circular in shape, having a bottom 107, two half panels 102 and 103 and a pole-receiving through-channel 101, and one continuous curved side represented at three points 104, 105 and 106 for orientation in the following discussions, and an open top 110.

Mating of Stabilizer Components. One particular advantage the present invention provides is that the stabilizer system may be installed around a previously-installed utility pole, and does not require installation at the same time as the utility pole, which we refer to as being "retrofittable". This allows installation of the stabilizing system to the millions of utility poles already installed around the country, and allows for selective installation only around poles which have shown a tendency to tilt or which are expected to be subject to extreme forces leading to tilting (e.g., end pole, corner pole, poles in high wind areas, etc.). Another particular advantage to the present invention is that, unlike poured concrete, it can easily be unloaded (i.e., ballast removed), and then deinstalled and reused on the same or another pole.

Figure 6:
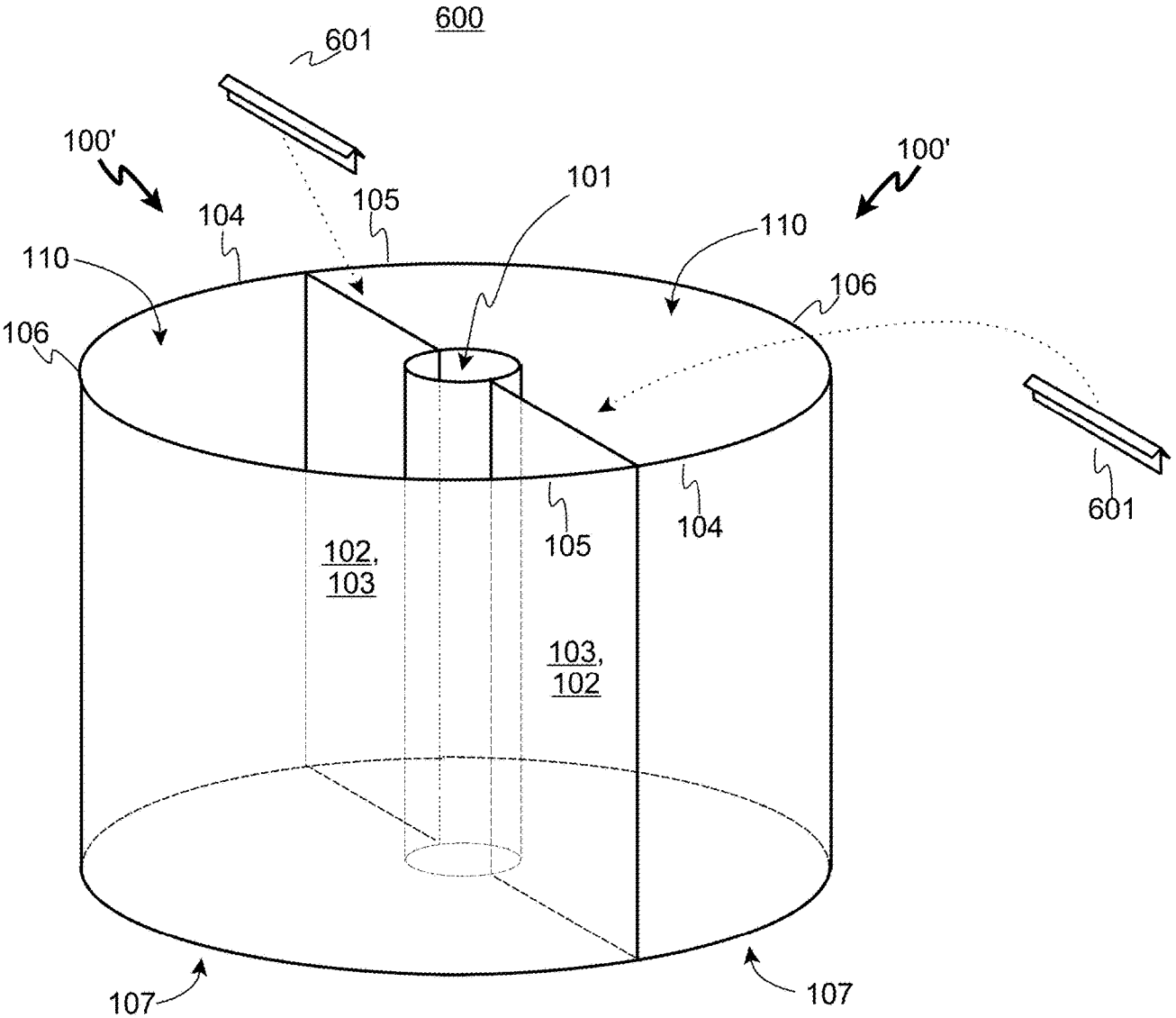
FIG. 6 illustrates a perspective view of a retrofittable stabilizer for utility poles and columns according to the present invention, including two ridge caps and two mated container components.

For installation without having to remove the already-installed utility pole or column, two or more of the stabilizer components are placed into an excavated pit with the half panels 102 and 103 mated towards each other, as shown in FIG. 6. The utility pole or column is captured in the through-channels 101 of the two or more stabilizer components 100', and the stabilizer components are secured to each other, such as by fixing bolts and nuts through flanges as earlier shown in FIG. 1. Any rain, snow melt or flood run-off waters which fall into the stabilizer system, even if it accumulates to a considerable depth in the system, will not come into contact with the captured pole in the through-channel, thereby preventing saturation and possible rot of the bottom portion of the pole.

However, some rain and melted snow or ice may run down the captured pole from above the mated half-panels 102 and 103, which could potentially run down between the half-panels such that it is not captured within the stabilizer components 100'. Optionally, to prevent this incursion of moisture, ridge caps 601 may be placed between the opposing and mated half-panels 102 and 103, to divert this portion of the leaked fluids into one of the two (or more) stabilizer components 100'. This protects the half-panels from corrosion, freeze damage, and the like, and allows any moisture running down the pole to be handled and drained effectively.

Figure 7:
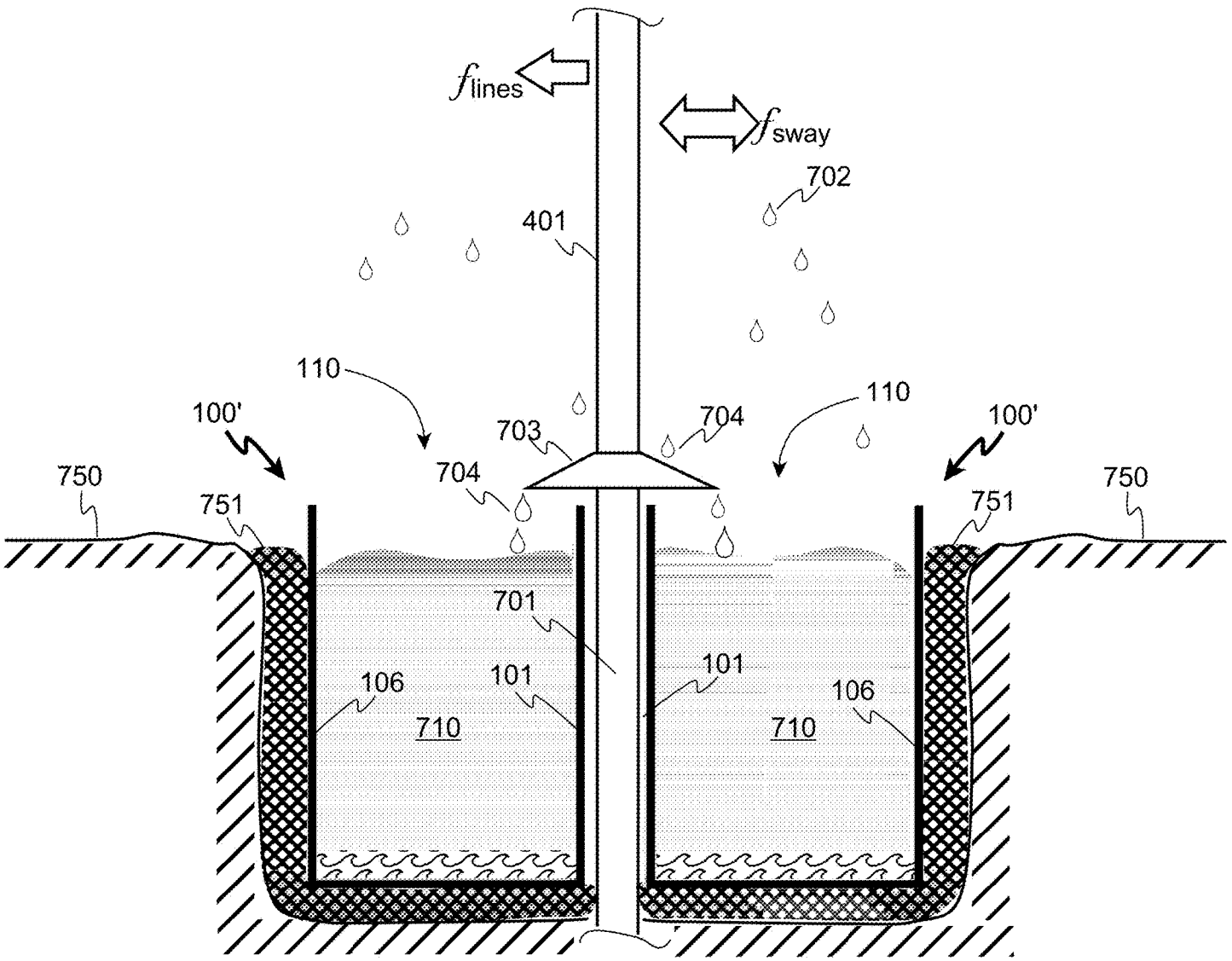
FIG. 7 provides an installed cut-away view of at least one embodiment of the present invention as installed, with an optional drip diverter component.
Figure 8:
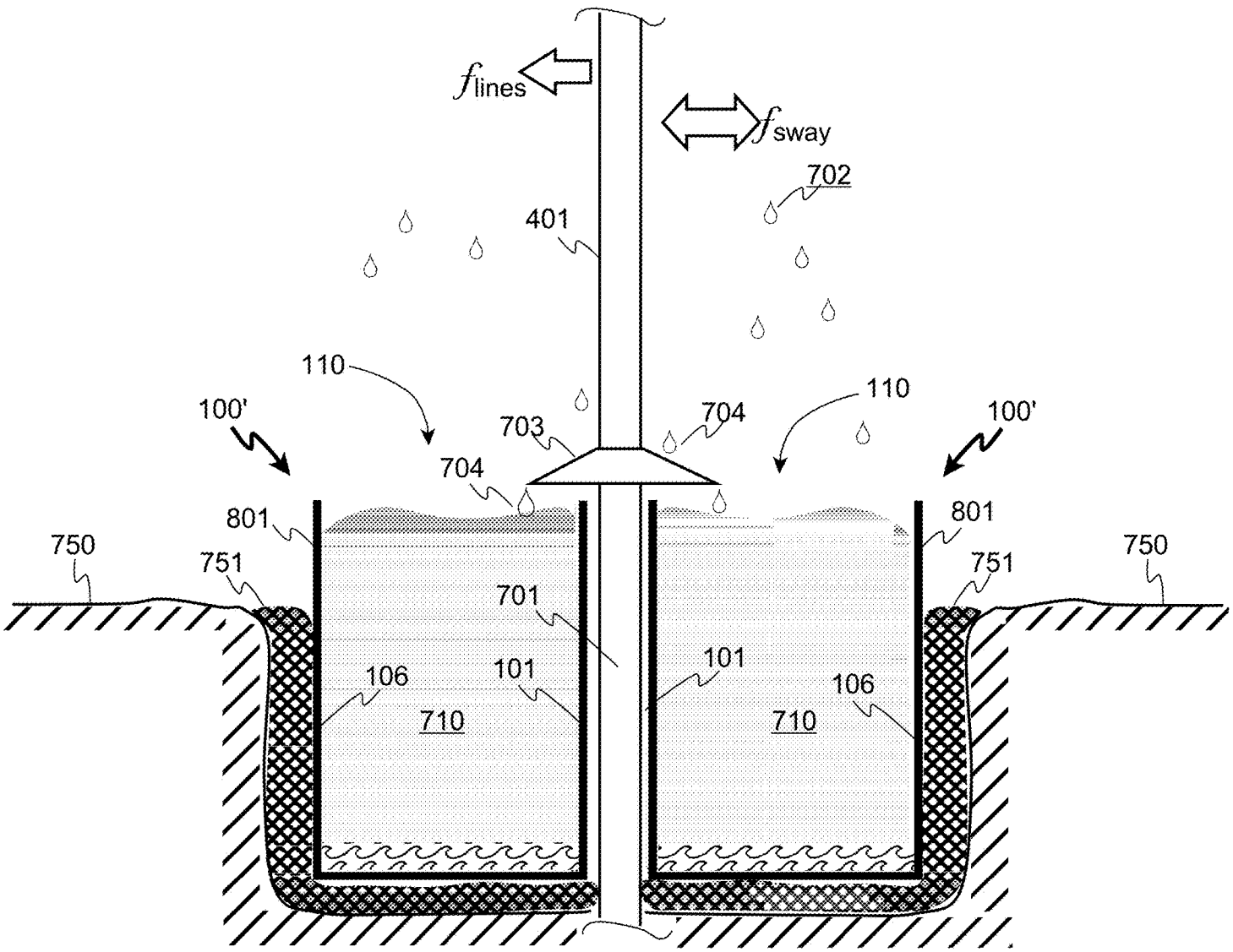
FIG. 8 provides an installed cut-away view of at least one embodiment of the present invention as installed with a portion of the retrofittable stabilizer exposed above ground level to provide additional protection of the base of the pole, with an optional drip diverter component.

Installation of Stabilizer System. FIG. 7 shows a cut-away view of at least one embodiment of the present invention as installed, wherein the cut-away is taken through the utility pole 401 and the stabilizer components 100' or 100. Rain, ice melt, snow melt, etc., 702 fall or run into one of the stabilizer component's open tops 110. Some water may run down the pole, which is optionally diverted into the open tops 110 by a diverter cone 703 as shown.

To install the stabilizer system without removing a previously-installed utility pole or column (e.g., bridge support) dirt 750 is excavated away from around the bottom portion of the pole or column 401 a sufficient distance and depth to receive the two or more stabilizer components 100' or 100. The depth of the excavation may be sufficient that the tops of the containment components 100 or 100' are essentially flush with ground level, or even above ground level 801 to prevent surface water from entering the stabilizer system and/or to protect the base of the pole from insects, vines, and collisions with mowing equipment.

Prior to dropping the stabilizer components 100 or 100' into the excavated pit, preferably a levelling material such as sand or gravel 751 is placed in the bottom of the pit. After the stabilizer components have been maneuvered to capture the pole or column in the through-channel 101, and the stabilizer components have been secured to each other, the excavated pit is back filled around the outside walls 104, 105, and 106 of the stabilizer components to provide back pressure against the weight of ballast materials 710 and any accumulated water. Optionally, a grate or lid may be placed over the open tops 110 of the stabilizer components for safety and/or diversion of rain.

Materials and Manner of Fabrications. The stabilizer components 100 and 100' may be constructed of a wide range of materials, as may be appropriate for various applications and to meet any applicable regulatory requirements. Among these materials, but not limited to, are fiberglass, plastic, steel-reinforced concrete, stainless steel, and aluminum. In one manner of fabrication, a frame of square tube stock is constructed along the edges of the containment component, and panels of metal, such as aluminum, are disposed inside the frame, such as by welding. For such a structure, holes may be drilled in the vertical elements of the frame which define the outer edges of the mating half-panels 102 and 103 so that they may be readily bolted to the corresponding vertical elements on the mating containment component.

Pre-cast concrete units would be heavier, requiring more substantial equipment to transport and install them, but also would be more conducive to creation of stabilizers capable of application to taller and heavier poles and columns.

Ballast material may be of any readily-available and easily handled type, such as but not limited to gravel, sand, dirt, scrap metal, stone, and even water if the top of which is maintained below the freeze depth in the applicable area of installation.

Figure 9:
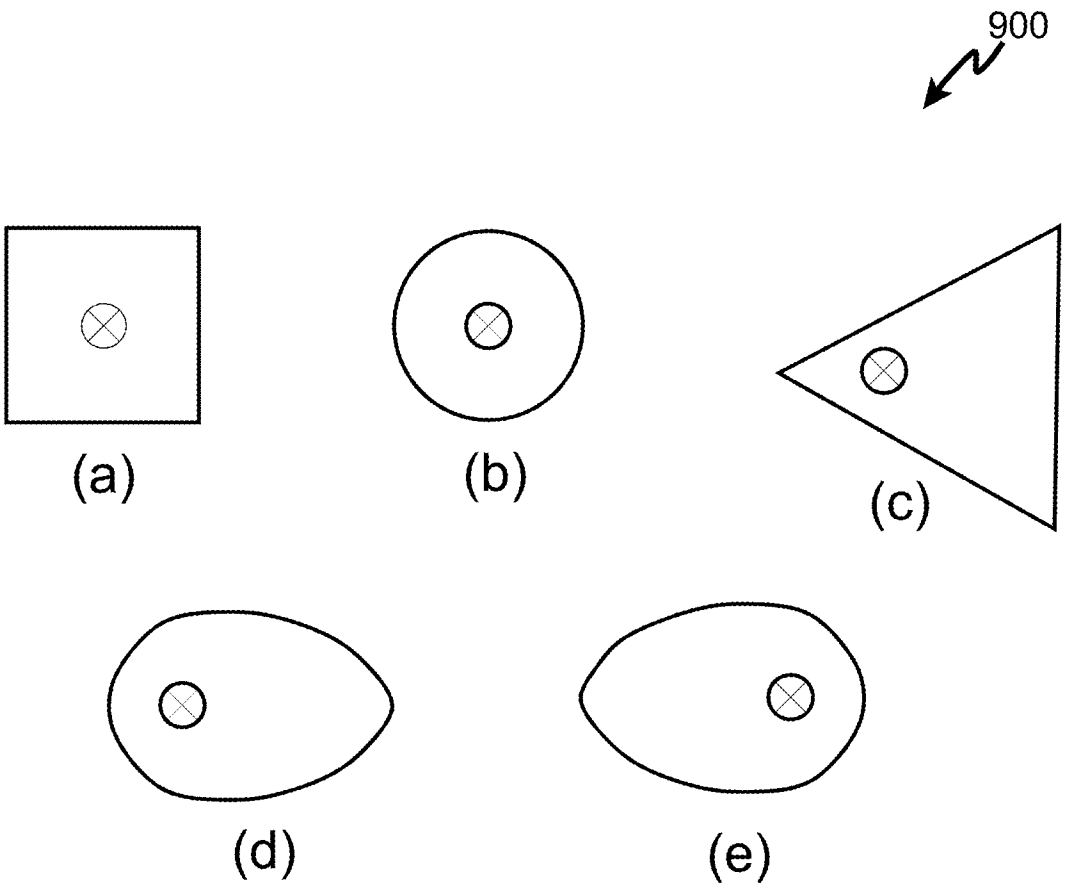
FIG. 9 illustrates, from a top-down view, a variety of shapes of stabilizer systems for a wide array of installation applications.
Figure 10:
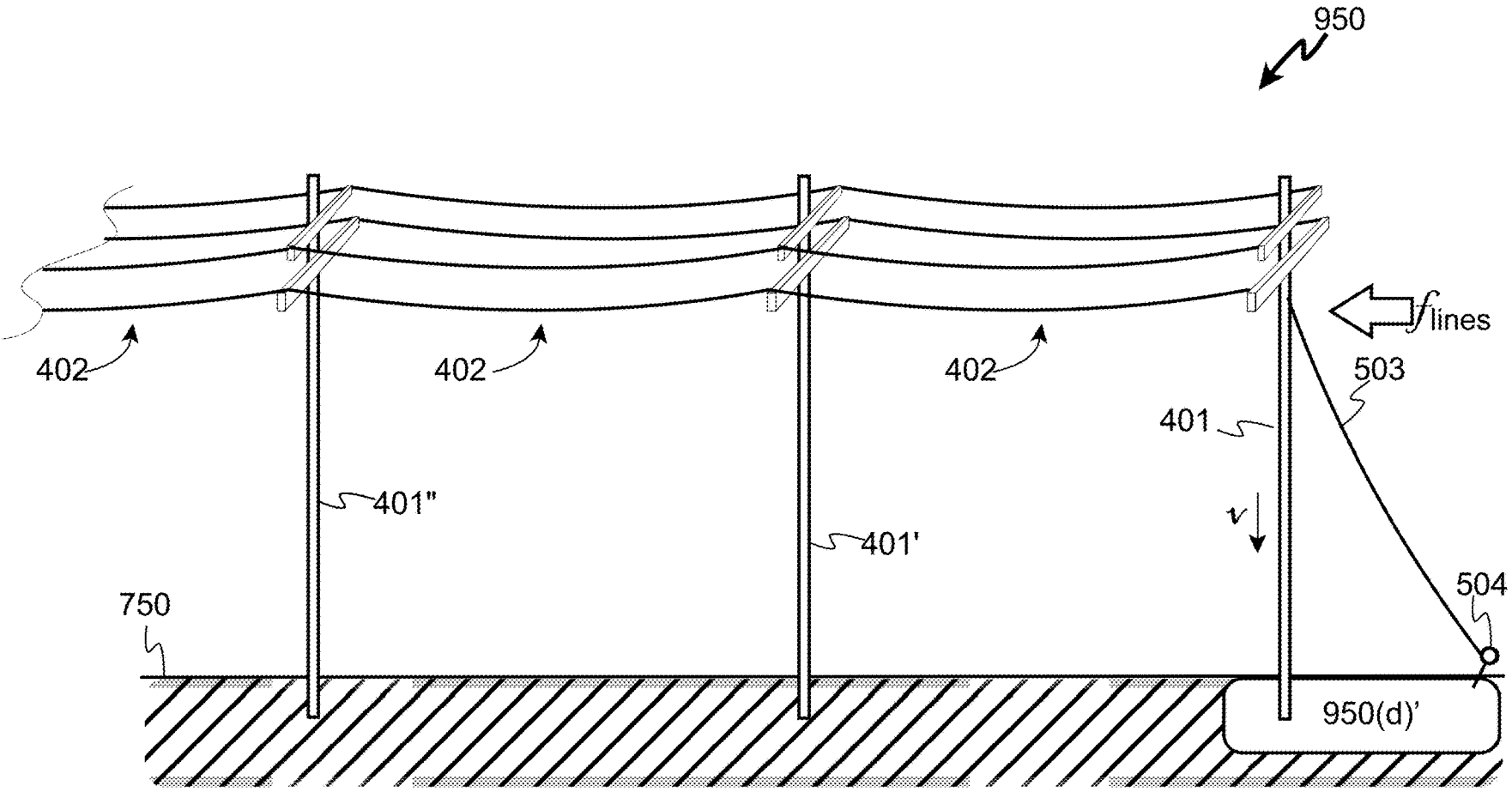
FIG. 10 depicts an embodiment according to the present invention that anchors a ground-end of a guy wire such that multiple stabilizer devices and methods can be employed advantageously together.

Additional Shapes of Stabilizer Systems. Referring now to FIG. 9, a top-down view 900 of a variety of other shapes of stabilizer systems is shown (a) through (e), according to the present invention. The pole or column is represented by the circle with an X through it. These shapes, and others which fall within the spirit and scope of the present invention, may be useful in many different scenarios of installation in order to provide stabilization on a grade, near an obstacle (roadway, ditch, river, wall, drop off, etc.), and to provide optional foundations for guy wires or diagonal stabilizers, as shown 950 in FIG. 10 wherein the oblong or egg-shaped stabilizer system (d) in provided with a guy wire anchor 504 towards a distal end from the pole 401.

Figure 11:
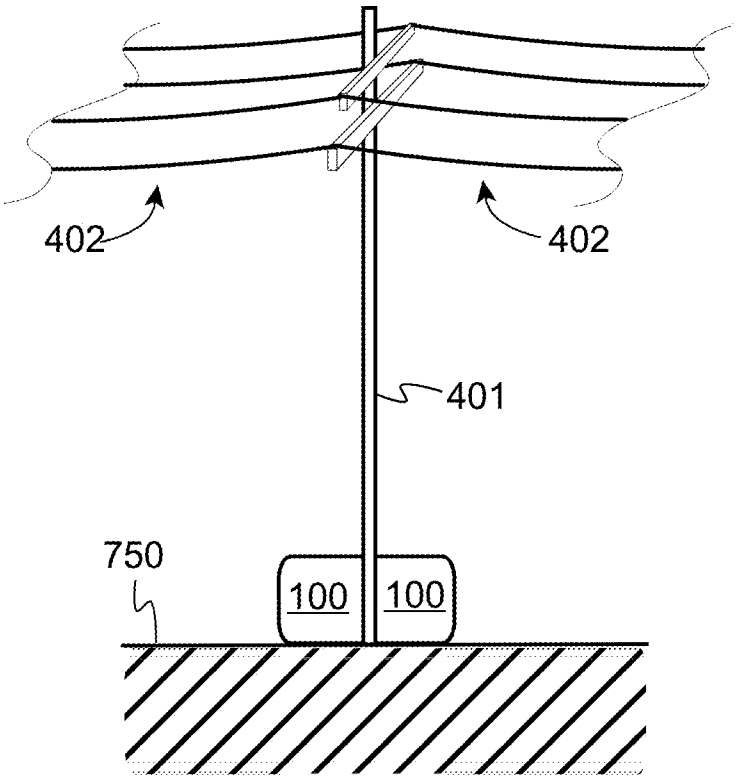
FIG. 11 shows an available manner of use according to the present invention in which the retrofittable stabilizer is installed above ground, with a bottom surface of the stabilizer resting on the top surface of the ground, pavement or on cement.

Additional Methods of Use of Stabilizer Systems. Referring now to FIG. 11, an available manner of use according to the present invention is shown in which a retrofittable stabilizer is installed above ground, with its bottom surface resting on the top surface of the ground, pavement or on cement. Such installations may be particularly useful during recovery from an event in which many power poles have been blown or pulled down, or when setting up temporary poles for construction, re-routing power, etc. A retrofittable stabilizer with sufficient size and weight (ballast) could hold a pole or column for temporary placement without digging, drilling or excavating as is needed for conventional poles.

Figure 12:
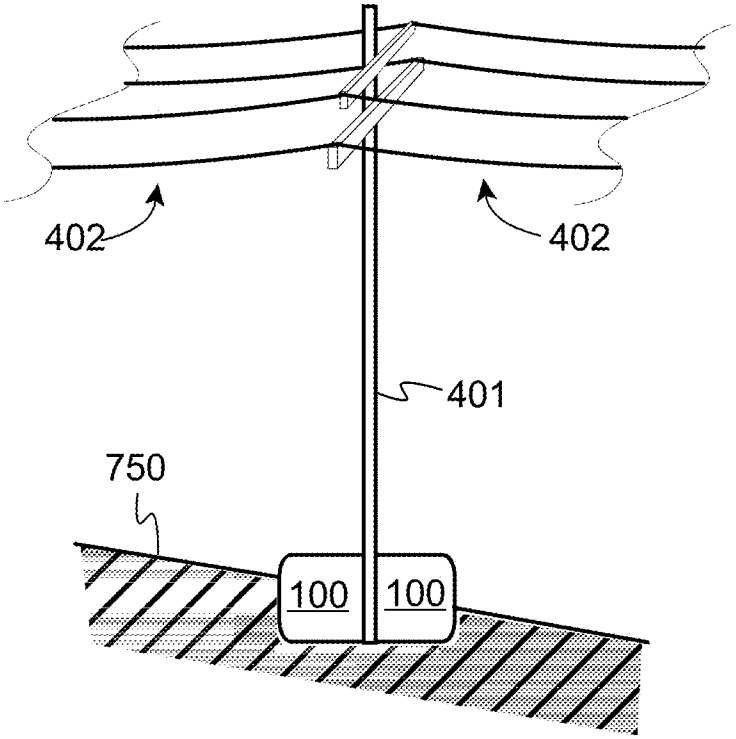
FIG. 12 shows an available manner of use according to the present invention in which the retrofittable stabilizer is installed "on ground" in which the stabilizer is used on a sloping grade of ground with the uphill portion of the stabilizer installed below or partially below ground level, and with the downhill portion of the stabilizer installed above or partially above ground.

FIG. 12 shows another available manner of use according to the present invention in which the retrofittable stabilizer is installed "on ground" in which the stabilizer is used on a sloping grade of ground with the uphill portion of the stabilizer installed below or partially below ground level, and with the downhill portion of the stabilizer installed above or partially above ground.

Conclusion. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless specifically stated otherwise.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

It will be readily recognized by those skilled in the art that the foregoing example embodiments do not define the extent or scope of the present invention, but instead are provided as illustrations of how to make and use at least one embodiment of the invention. The following claims define the extent and scope of at least one invention disclosed herein.

What is claimed is:

1. A method of use of a stabilizer system comprising steps of:

excavating to create a void around a utility pole already installed in ground;

arranging a first open-top stabilizer component and a second open-top stabilizer component around a base of the utility pole into at least a part of a void created by the excavating, wherein:

the first stabilizer component comprises:

a first bottom portion having at least a first edge and a second edge;

one or more apertures formed in the first bottom portion which allow liquids to drain while retaining a solid ballast material;

first and second co-planar half-panels joined to the at least first edge of the first bottom portion, each half-panel having a height dimension;

a first through-channel portion disposed vertically between the first and second half-panels and having an equal height to the height dimension of the two co-planar half-panels;

at least a first side wall joined to the second edge of the first bottom portion and joined to the two co-planar half-panels;

the second stabilizer component comprises:

a second bottom portion having at least a third edge and a fourth edge;

one or more apertures formed in the second bottom portion which allow liquids to drain while retaining a solid ballast material;

third and fourth co-planar half-panels joined to the third edge of the second bottom portion, each half-panel having a height dimension;

a second through-channel portion disposed vertically between the third and fourth half-panels and having an equal height to the height dimension of the third and fourth co-planar half-panels;

at least a second side wall joined to the second edge of the bottom portion and joined to the third and fourth co-planar half-panels; and fastening the first stabilizer component to the second stabilizer component using one or more fasteners; and filling the first stabilizer component and the second stabilizer component with a ballast material through the open tops of the first stabilizer component and the second stabilizer component, thereby forming and installing a ballast filled container with an open top around the utility pole received in the first and second through channels.

2. The method of use as set forth in claim 1 further comprising installing one or more drip diverter components around the utility pole above the first and second stabilizer components.

3. The method of use as set forth in claim 2 wherein the drip diverter component comprises a drip ridge configured to divert downward moving fluids from entering between mated half-panels and entering instead into a volume defined by the bottom portion, the at least one side wall and the half-panels.

4. The method of use as set forth in claim 2 wherein the drip diverter component comprises a cone diverter configured to be installed around the utility pole to divert downward moving fluids from entering into the first and second through-channels and entering instead into the open tops of the first and second stabilizer components.

5. The method of use of claim 1 further comprising one or more of the first and second stabilizer components to the utility pole.

6. The method of use of claim 1 in which the filling with ballast material comprises filling with one or more materials selected from the group consisting of rock, gravel, sand, scrap material, and material removed during the excavating.

7. The method of use of claim 1 in which the excavating produces a void large enough to receive the first stabilizer component and the second stabilizer component entirely below a surface level of ground.

8. The method of use of claim 1 in which the excavating produces a void large enough to receive at least one of the first stabilizer component and the second stabilizer component partially below and partially above a surface level of ground.

9. The method of use of claim 8 in which the surface level of ground comprises a non-horizontal grade.

10. The method of use of claim 1 wherein the bottom portion of the at least one of the first stabilizer component and the second stabilizer component is installed on a surface level of ground.

* * * * *